US009033187B2

(12) United States Patent
Luebke

(10) Patent No.: US 9,033,187 B2
(45) Date of Patent: May 19, 2015

(54) BOTTLE TOP LIQUID AERATOR

(75) Inventor: Jamin Luebke, Minneapolis, MN (US)

(73) Assignee: Aerawine LLC, Minneapolis, MN (US)

( * ) Notice: Subject to any disclaimer, the term of this patent is extended or adjusted under 35 U.S.C. 154(b) by 0 days.

(21) Appl. No.: 13/253,606

(22) Filed: Oct. 5, 2011

(65) Prior Publication Data

US 2012/0111893 A1 May 10, 2012

Related U.S. Application Data

(60) Provisional application No. 61/390,428, filed on Oct. 6, 2010, provisional application No. 61/415,381, filed on Nov. 19, 2010, provisional application No. 61/479,692, filed on Apr. 27, 2011.

(51) Int. Cl.

| | |
|---|---|
| ***B67D 7/76*** | (2010.01) |
| ***B65D 47/32*** | (2006.01) |
| ***B01F 3/04*** | (2006.01) |
| ***B01F 5/04*** | (2006.01) |

(52) U.S. Cl.

CPC ..... *B65D 47/32* (2013.01); *B01F 3/0446* (2013.01); *B01F 5/0428* (2013.01); *B01F 2215/0072* (2013.01)

(58) Field of Classification Search

CPC ..... B67D 7/76

USPC ..... 99/323.1; 426/474; 261/7–8, 76–77, 261/DIG. 56, DIG. 75; 222/478–479, 222/189.09, 190, 547, 567, 460–462; 215/902

See application file for complete search history.

(56) References Cited

U.S. PATENT DOCUMENTS

| | | | | | |
|---|---|---|---|---|---|
| 2,087,824 | A | * | 7/1937 | Tully | 222/606 |
| 2,164,314 | A | * | 7/1939 | Edwards | 222/479 |
| 2,204,524 | A | * | 6/1940 | Bender | 222/478 |
| 2,435,033 | A | * | 1/1948 | Campbell | 215/387 |
| 2,642,207 | A | * | 6/1953 | Renzi | 222/479 |
| 3,233,797 | A | * | 2/1966 | Conry | 222/477 |
| 3,235,133 | A | * | 2/1966 | Zimmerman et al. | 222/478 |
| 3,595,421 | A | * | 7/1971 | Sanchis | 215/309 |
| 3,966,099 | A | * | 6/1976 | Sanford et al. | 222/478 |
| 4,162,129 | A | | 7/1979 | Bartholemew, Jr. | |
| 4,494,452 | A | | 1/1985 | Barzso | |
| 4,555,046 | A | * | 11/1985 | Bennett | 222/189.07 |

(Continued)

OTHER PUBLICATIONS http://www.vin-aire.com, Aug. 26. 2010.

(Continued)

*Primary Examiner* — Paul R Durand
*Assistant Examiner* — Andrew P Bainbridge
(74) *Attorney, Agent, or Firm* — Vidas, Arrett & Steinkraus

(57) ABSTRACT

A bottle aerator of the type having a venturi tube having a constricted section with a narrower cross-sectional section and a fluid inlet section having a wider cross-sectional section, such that the fluid pressure is lower in the constricted section compared to the pressure in the fluid inlet section, and the fluid speed is higher in the constricted section compared to the fluid speed in the fluid inlet section, which is improved by the constricted section being constructed and arranged so that when the bottle aerator is inserted into a bottle, the constricted section is positioned inside the bottle. The air inlet is provided at or below the constricted section, which allows air from outside the bottle to mix with the fluid as it passes through the constricted section, so that the fluid is aerated while still inside the bottle.

22 Claims, 18 Drawing Sheets

(56) References Cited

U.S. PATENT DOCUMENTS

| | | | | |
|---|---|---|---|---|
| 5,595,104 | A | 1/1997 | Delaplaine | |
| 5,713,263 | A | 2/1998 | Burks, III | |
| 6,170,719 | B1 * | 1/2001 | Wilkinson et al. | 222/479 |
| 6,568,660 | B1 | 5/2003 | Flanbaum | |
| 7,614,614 | B2 | 11/2009 | Sabadicci et al. | |
| 7,841,584 | B2 | 11/2010 | Sabadicci et al. | |
| 8,011,540 | B1 | 9/2011 | Peckels | |
| 8,342,367 | B2 * | 1/2013 | Tuyls et al. | 222/105 |
| 8,523,019 | B2 * | 9/2013 | Drobot et al. | 222/190 |
| 2007/0256568 | A1 * | 11/2007 | Nudi et al. | 99/275 |
| 2010/0006603 | A1 | 1/2010 | Weinberg et al. | |
| 2010/0025867 | A1 | 2/2010 | Benton et al. | |
| 2010/0058933 | A1 | 3/2010 | Cheng | |
| 2010/0091605 | A1 | 4/2010 | Rasmussen et al. | |
| 2011/0024925 | A1 | 2/2011 | Mauffette | |
| 2011/0042835 | A1 | 2/2011 | Sabadicci et al. | |

OTHER PUBLICATIONS http://www.vinoair.com, Aug. 26, 2010.

* cited by examiner

BOTTLE TOP LIQUID AERATOR

CROSS-REFERENCE TO RELATED APPLICATIONS

This application claims priority from provisional application no. 61/390,428, filed Oct. 6, 2010, and claims priority from provisional application no. 61/415,381, filed Nov. 19, 2010, and also claims priority from provisional application no. 61/479,692, filed Apr. 27, 2011, the entire contents of each of which are hereby incorporated in their entirety by reference.

STATEMENT REGARDING FEDERALLY SPONSORED RESEARCH

Not Applicable

FIELD OF THE INVENTION

The present invention relates to bottle aerators, and more particularly pertains to bottle aerators in which the aeration takes place inside the bottle, as the liquid is poured from the bottle.

BACKGROUND OF THE INVENTION

Prior art bottle aerators which aerate the liquid in the bottle are known, for example:

US 2010/0058933 published Mar. 11, 2010;

U.S. Pat. No. 5,595,104, issued Jan. 21, 1997, and

U.S. Pat. No. 4,494,452, issued Jan. 22, 1985.

Prior art bottle aerators which aerate the liquid as it is poured from the bottle are also known, for example:

U.S. Pat. No. 8,011,540, issued Sep. 6, 2011;

US 2011/0024925, published Feb. 3, 2011;

US 2010/0091605, published Apr. 15, 2010;

US 2010/0025867, published Feb. 4, 2010;

US 2010/0006603, published Jan. 14, 2010, and

U.S. Pat. No. 6,568,660, issued May 27, 2003.

The VinOAir from Cork Pops Inc. also aerates as the liquid is poured from the bottle, and more information can be found at http://www.vinoair.com.

Prior art aerators which aerate the liquid after it is poured out of the bottle are also known, for example:

US 2011/0042835, published Feb. 24, 2011;

U.S. Pat. No. 7,841,584, issued Nov. 30, 2010;

U.S. Pat. No. 7,614,614, issued Nov. 10, 2009;

U.S. Pat. No. 5,713,263, issued Feb. 3, 1998, and

U.S. Pat. No. 4,162,129, issued Jul. 24, 1979.

The Vin-Aire from Prime Wine Products LLC also aerates after the liquid is poured from the bottle, and more information can be found at http://www.vin-aire.com.

None of these prior art bottle aerators aerate the liquid inside the bottle, as the liquid is poured from the bottle. An advantage of aerating the liquid inside the bottle, as the liquid is poured from the bottle, is that it allows the spout to be longer, but with less protruding above the top of the bottle.

The entire contents of each of the patents, patent publications and websites discussed herein is hereby incorporated by reference.

Applicant has also found that the prior art designs do not optimize the aeration with the rate at which the liquid pours from the bottle.

BRIEF SUMMARY OF THE INVENTION

Applicant has invented a better bottle aerator of the type having a venturi tube having a constricted section with a narrower cross-sectional section and a fluid inlet section having a wider cross-sectional section, such that the fluid pressure is lower in the constricted section compared to the pressure in the fluid inlet section, and the fluid speed is higher in the constricted section compared to the fluid speed in the fluid inlet section, which is improved by the constricted section being constructed and arranged so that when the bottle aerator is inserted into a bottle, the constricted section is positioned inside the bottle.

The air inlet is provided at or below the constricted section, which allows air from outside the bottle to mix with the fluid as it passes through the constricted section, so that the fluid is aerated while still inside the bottle.

Applicant has invented a better bottle aerator of the type having a venturi tube having a constricted section with a narrower cross-sectional section and a fluid inlet section having a wider cross-sectional section, such that the fluid pressure is lower in the constricted section compared to the pressure in the fluid inlet section, and the fluid speed is higher in the constricted section compared to the fluid speed in the fluid inlet section, which is improved by providing an air inlet at or below the constricted section, which allows air from outside the bottle to mix with the fluid as it passes through the constricted section.

The constricted section is constructed and arranged so that when the bottle aerator is inserted into a bottle, the constricted section is positioned inside the bottle, so that the fluid is aerated while still inside the bottle.

Applicant has found that the air can be introduced into the venturi tube below the bottom section, in the bottom section or in the constricted section, and in a variety of locations, such as on the side of the bottle aerator or directly in the air channel.

Applicant has also found that an additional venturi tube can be attached to a bottle aerator to further aerate the fluid, using the air already entrained in the fluid.

Applicant has also found through experimentation that it can improve the performance of the VinOAir wine aerator by sliding the elastic extension disclosed herein onto the bottom portion of the VinOAir, which has the effect of restricting the air outlet in the VinOAir wine aerator. This has the effect of speeding the flow rate of wine out of the bottle, with no loss in aeration.

DETAILED DESCRIPTION OF THE INVENTION

Figure 1:
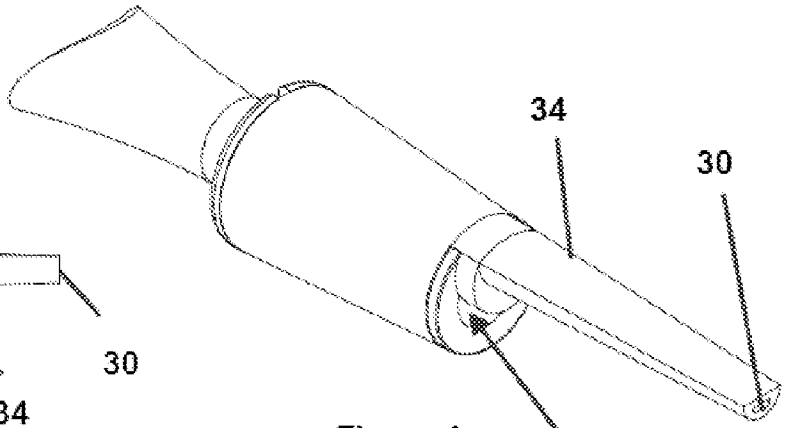
FIG. 1 is a side perspective view of an embodiment of the bottle pourer
Figure 2:
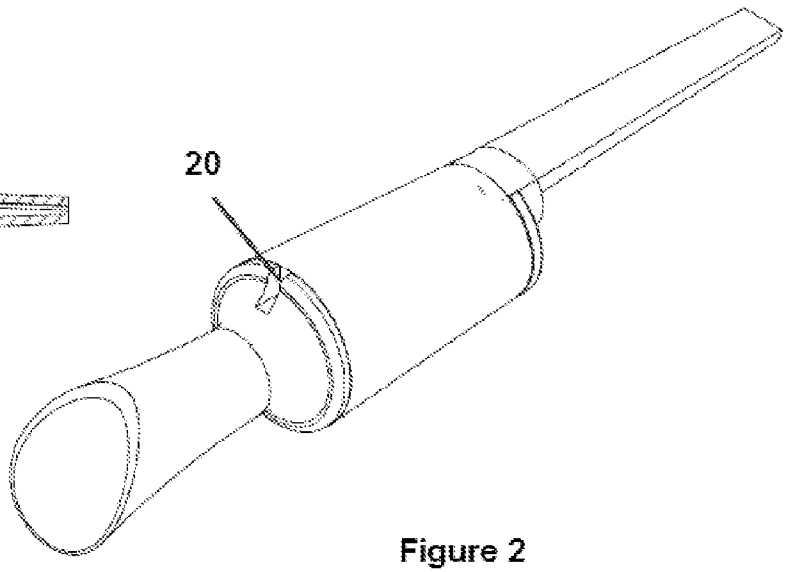
FIG. 2 is a different side perspective view of the embodiment of FIG. 1.
Figure 3:
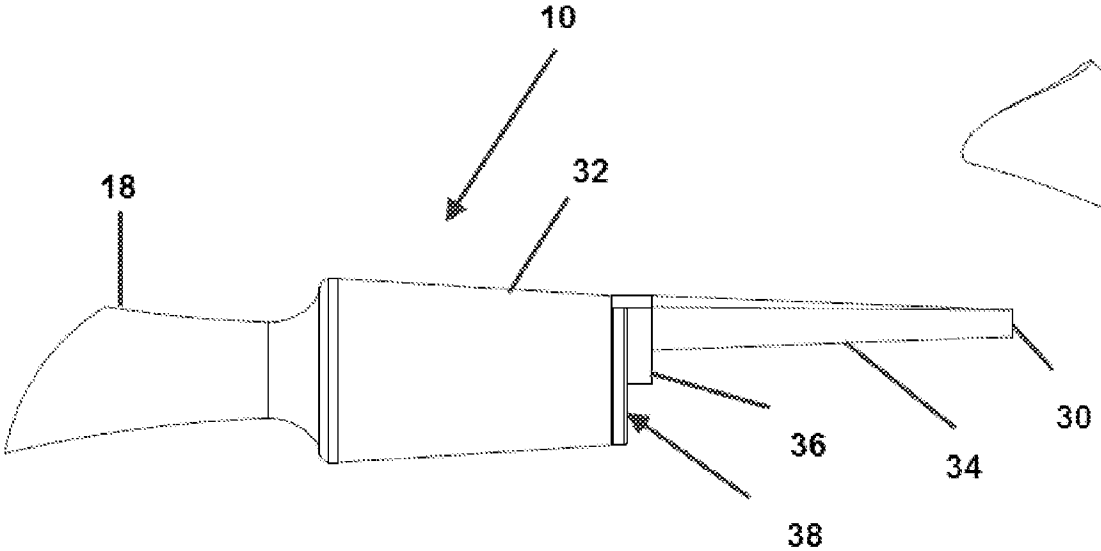
FIG. 3 is a side view of the embodiment of FIG. 1.
Figure 4:
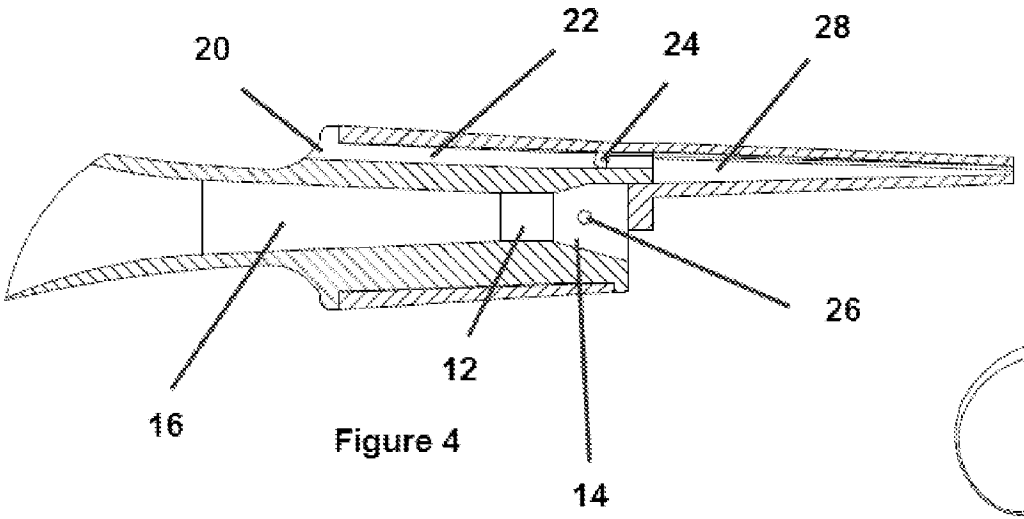
FIG. 4 is a cross-section view of the embodiment of FIG. 1.
Figure 5:
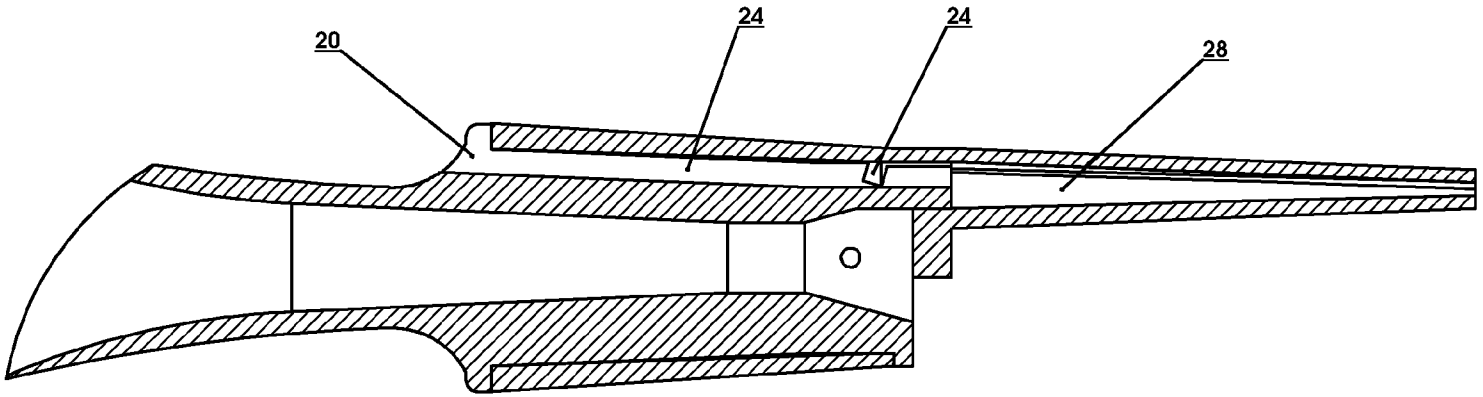
FIG. 5 is an enlarged cross-section view of the embodiment of FIG. 1.
Figure 6:
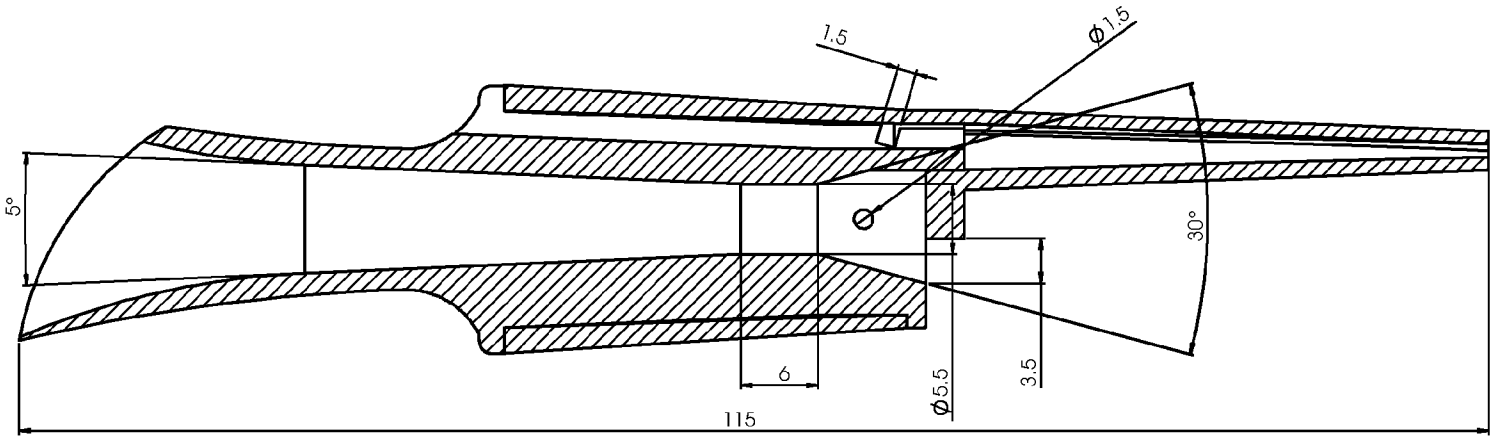
FIG. 6 shows the dimensions of the embodiment of FIGS. 1-5.

While this invention may be embodied in many forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Referring now to FIG. 1-6, an embodiment of the inventive bottle aerator is shown generally at 10. The bottle aerator includes a venturi tube having three sections, a narrow constriction section 12, a larger cross-sectional bottom section 14 and a larger cross-sectional top section 16. The aerator portion defining the venturi tube is preferably formed of molded plastic, but can be manufactured in any conventional manner. The narrow constriction section 12 has a diameter of 5.5 mm and extends 6 mm (see FIG. 6). The bottom section 14 flares out at a 30° angle. The top section 16 flares out at a 5° angle, and terminates in a pour spout 18. An air inlet is provided at 20, which allows air to enter air channel 22, side air channels 24, which permits the air to enter the bottom venturi tube section at air outlets 26 (one on either side). The air can also enter the air tube extension 28, and can exit out air outlet 30. An elastic sleeve 32 covers at least part of the venturi tube (the part which will sealingly engage with the bottle opening), and the venturi tube flares out at an angle of approximately 3.3°, so that the bottle pourer can act as a stopper, and can be removably engaged into the opening of a bottle, forming a seal with the top of the bottle.

In this embodiment, the overall length of the bottle aerator is 115 mm. The air tube extension 28 is defined by extension 34, which also includes restriction 36. Like elastic sleeve 32, the extension 34 is made of an elastic material. Restriction 36 is sized so that only about 3.5 mm of the fluid inlet 38 is accessible. The 30° angle on bottom venturi section 14, combined with the restriction 36 aid in the venturi effect. The length of extension 34 and the air outlet 30 equalize the system and help create a vacuum when pouring stops, to prevent dripping of the fluid. Applicant has found that restriction 36, which allows the fluid to go from a larger cross-section area, to a narrower cross-section area (at the restriction), and then to a larger cross-section area (including the inside the bottom section 14, above and to the right of the restriction 36, aids in the venturi effect by providing a location for additional air to gather to be sucked into the constricted section to aid in aeration. Without the restriction 36 (or in the embodiment of FIGS. 18-20 discussed below, the restriction coupled with the around 2 mm gap from the fluid inlet or around 5 mm from the lower end of the constricted section, i.e. the throat or narrowest point of the venturi tube), the aeration isn't as effective as with the restriction 36. It should be understood that the important point is to restrict the flow of fluid that passes through the construction, and that many ways exist to perform that function. For example, fluid such as wine could enter the bottle aerator below the fluid inlet with a restricted opening of approximately 3.5 mm and the opening could be located on the side of the bottle aerator. This would act as a flow restrictor and perform the same function as the restriction 36, positioned approximately 2 mm below the fluid inlet.

Figure 7:
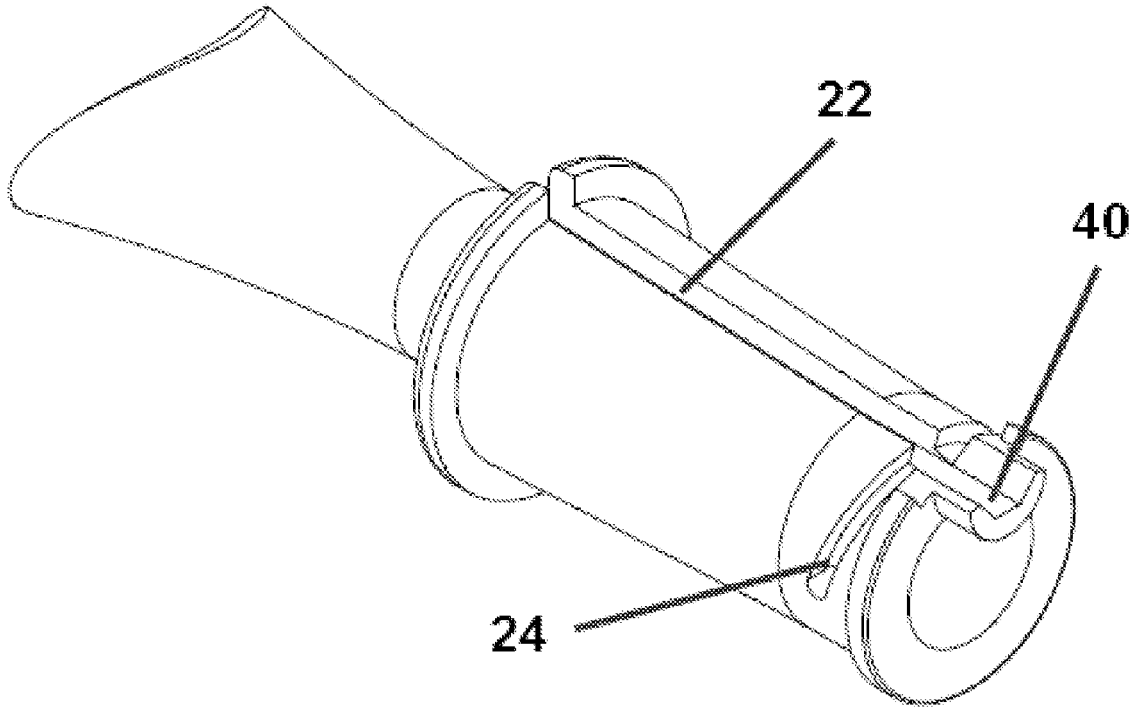
FIG. 7 is a side perspective view of the bottle aerator, without the elastic sleeve 32 or the extension 34 attached.
Figure 8:
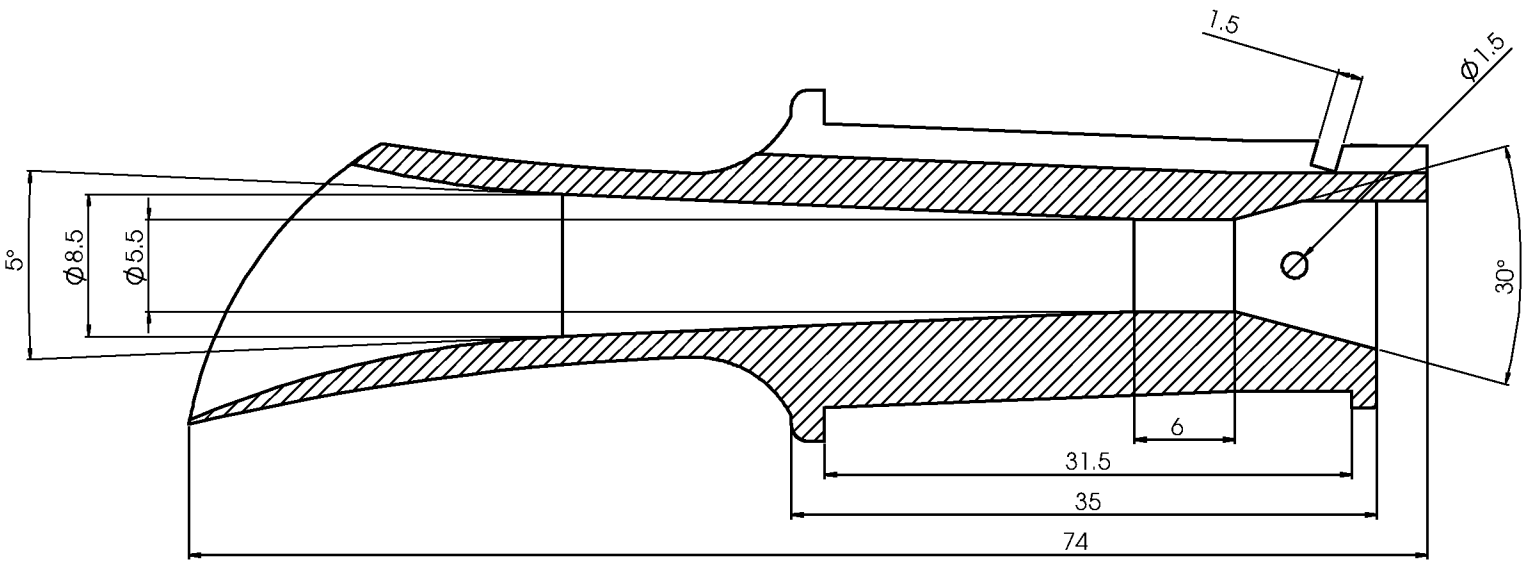
FIG. 8 shows the dimensions of FIG. 7.
Figure 9:
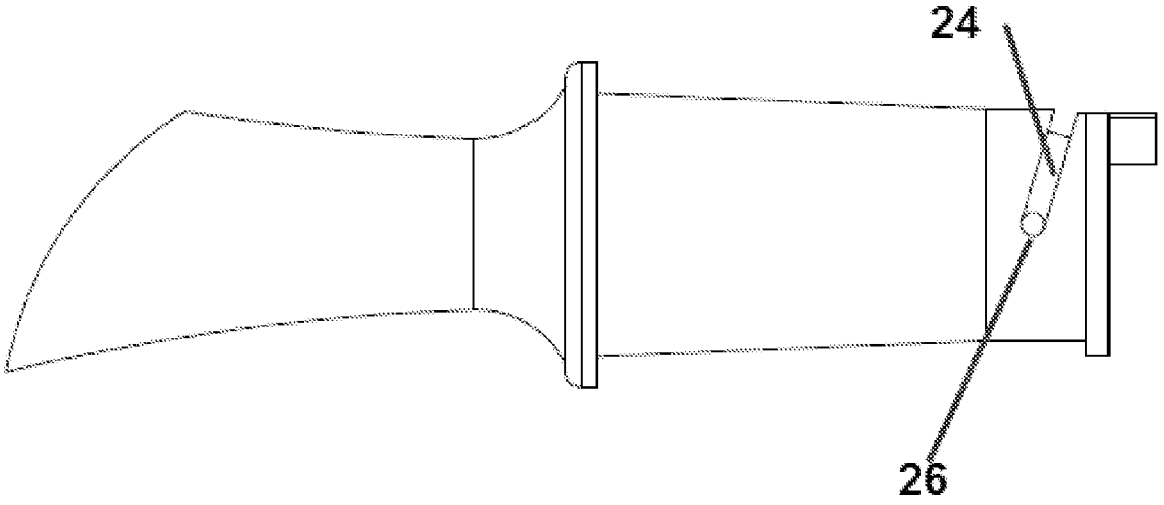
FIG. 9 is a side view showing the position of air outlet 26 in side air channel 24.

Referring now to FIGS. 7 and 8, air channel 22, and side air channels 24 are molded into the outside surface of the bottle aerator 10, and air channels 24 allow air to enter the at least one air outlet 26 (which can be located at either side, or on both sides), which allow air to enter bottom section 14 to aerate fluid passing through bottom section 14 and constriction section 12. Elastic sleeve 32 encloses and defines the air channels 22 and 24. FIG. 8 shows the dimensions of FIG. 7. Tab 40 slidably engages with extension 34, which can be made out of an elastic material, and can be easily removed for ease of cleaning. It should be understood that as many air outlets 26 as are desired, could be incorporated, as long as they are in communication with the air channel 22 and/or air channels 24.

Figure 10:
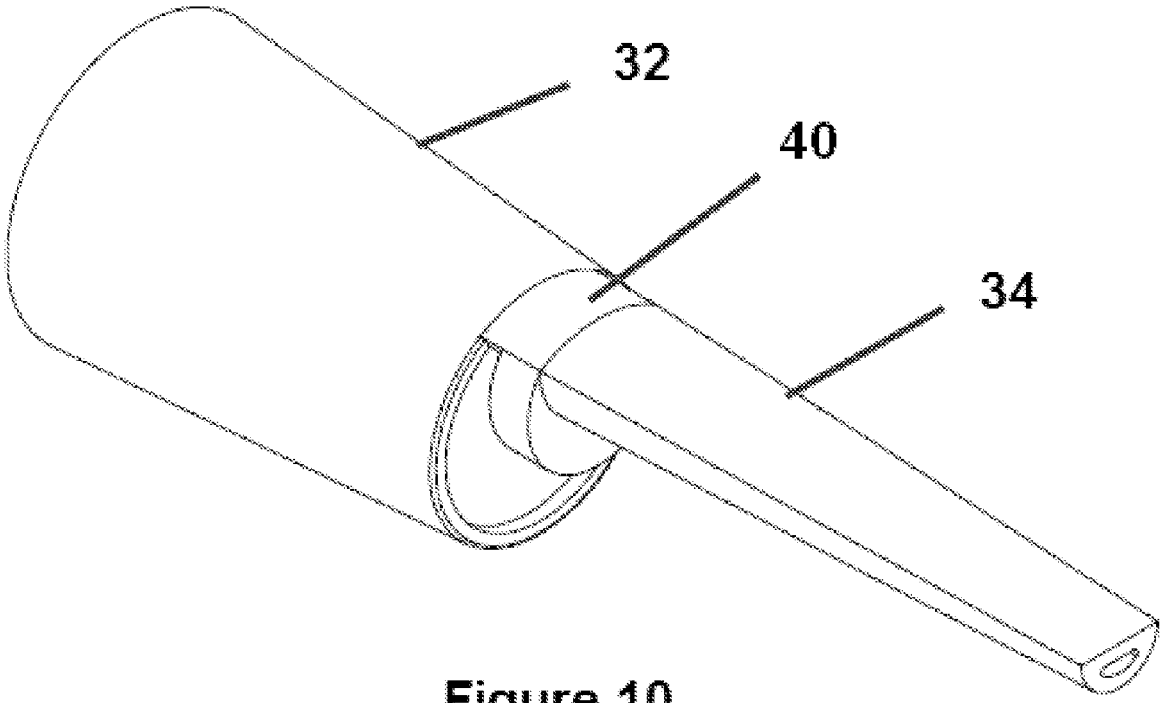
FIG. 10 is a perspective view of the sleeve 32, tab 40 and extension 34.
Figure 11:
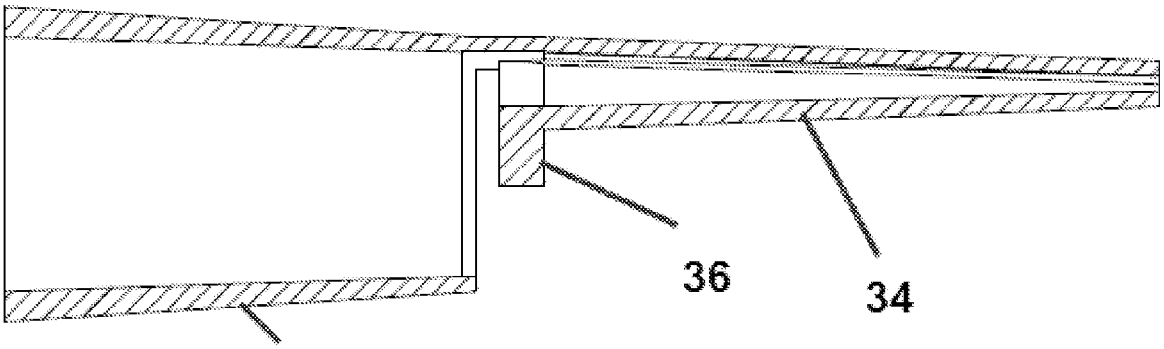
FIG. 11 is a cross-section view of FIG. 10.

Referring now to FIGS. 10 and 11, a perspective view and cross-sectional view of the elastic sleeve 32, tab 40, restriction 36 and extension 34 are shown.

Figure 12:
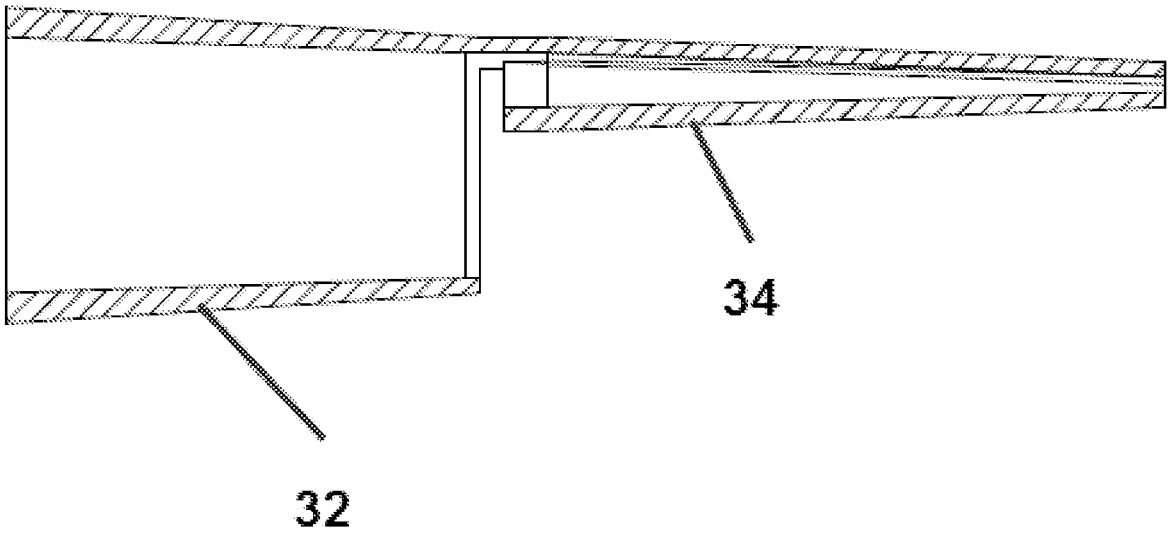
FIG. 12 is an alternative embodiment of FIG. 10, with no flow restriction 36.

FIG. 12 shows an alternative embodiment without the restriction 36.

Figure 13:
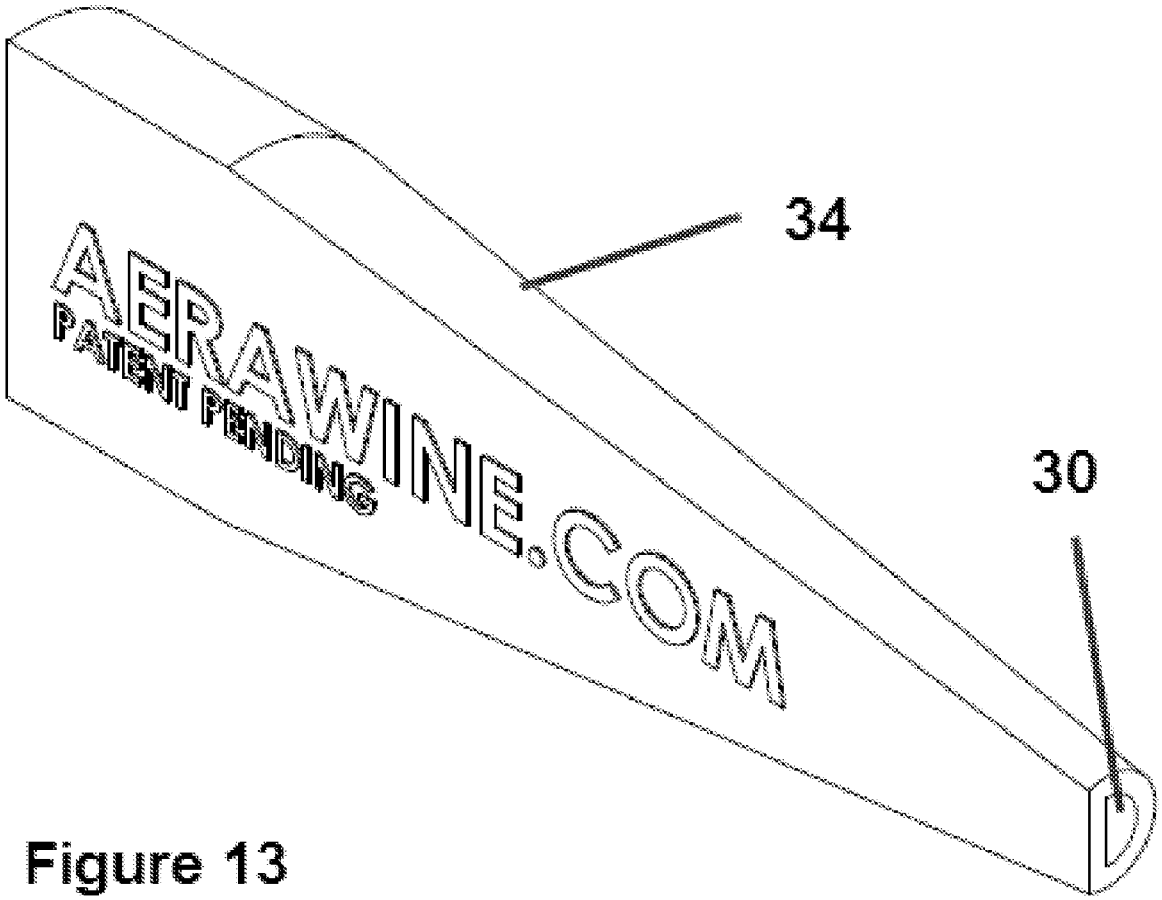
FIG. 13 is a perspective view of extension 34.
Figure 14:
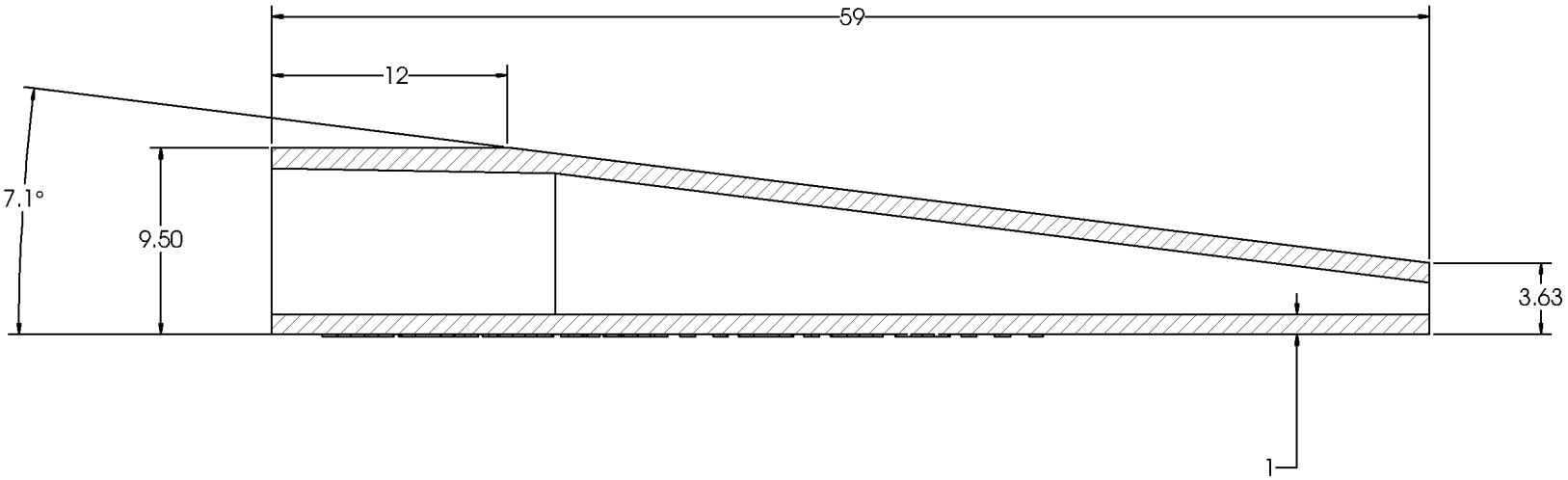
FIG. 14 is a cross-section view through the side of FIG. 13.

FIGS. 13 and 14 show a perspective view and the dimensions of extension 34.

In operation, bottle aerator 10 is inserted into an open bottle, so that elastic sleeve 32 forms a seal with the bottle opening. The bottom section 14 and narrow constriction 12 are positioned inside the bottle. As the bottle is poured, fluid begins to flow through fluid inlet 38, which creates a suction which pulls air into air inlet 20, down air channel 22, through side channels 24 to air outlet 26, and also down air tube extension 28 and out air outlet 30. As the fluid speeds up going through constriction 12, the fluid and air entering bottom section at 26 mix together, aerating the fluid. When pouring stops, the vacuum created by the air in 26, 24, 22 and 28, pull the fluid back and prevent the fluid from dripping.

Figure 15:
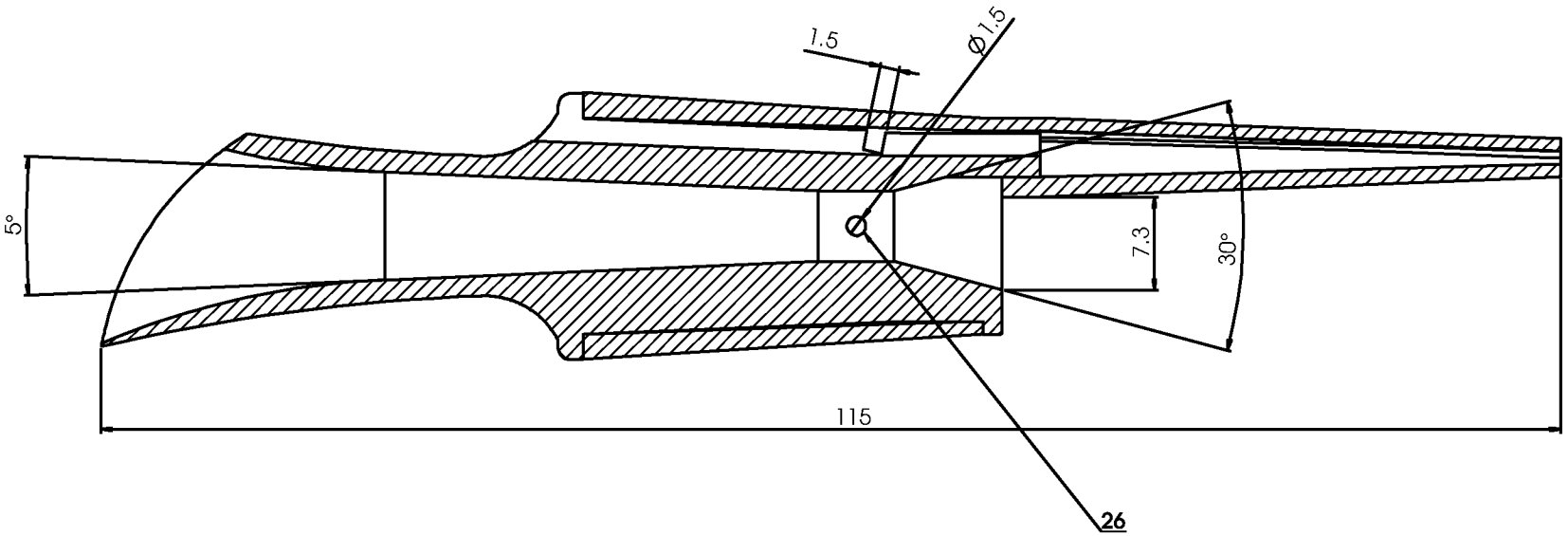
FIG. 15 is a cross-section view of an alternative embodiment, with no flow restriction 36 and with air outlet(s) 26 located in the constriction 12.

FIG. 15 is a cross-sectional view of an alternative embodiment of the bottle aerator 10. In this embodiment, no flow restriction 36 is included, allowing more fluid to flow through fluid inlet 38. Also, air outlet 26 has been positioned in the constriction section 12, rather than in bottom section 14.

Figure 16:
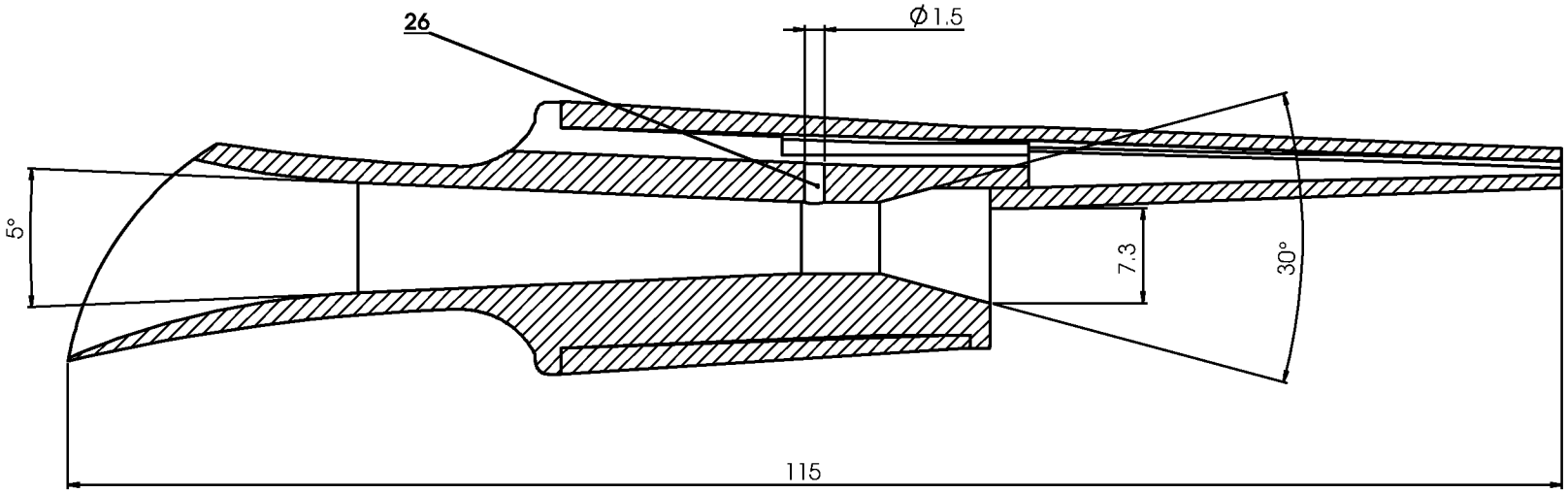
FIG. 16 is a cross-section view of an alternative embodiment, with no flow restriction 36 and with air outlet 26 located in the constriction 12, but located directly under air channel 22, eliminating the need for side channel(s) 24.

FIG. 16 is a cross-section view of an alternative embodiment, with no flow restriction 36 and with air outlet 26 located in the constriction 12, but located directly under air channel 22, eliminating the need for side channel(s) 24.

Figure 17:
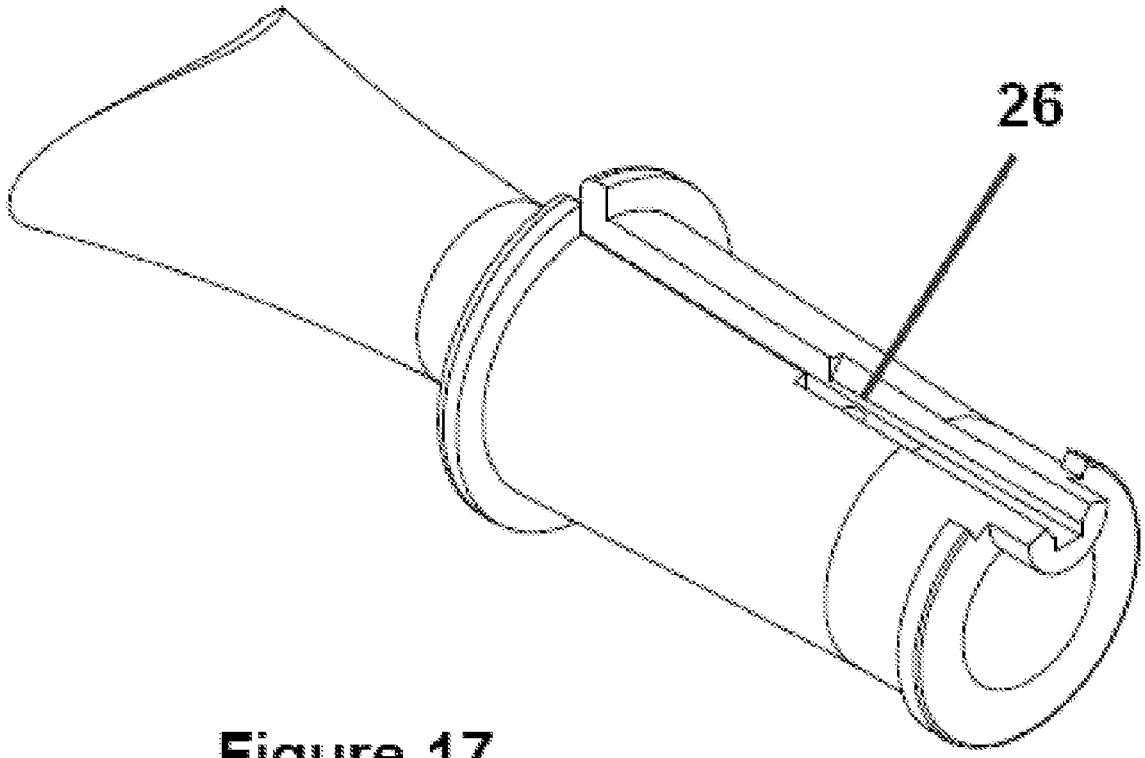
FIG. 17 is a top perspective view showing the top end of air outlet channel 26, terminating in air channel 22.

FIG. 17 shows a top view of air outlet channel 26.

Figure 18:
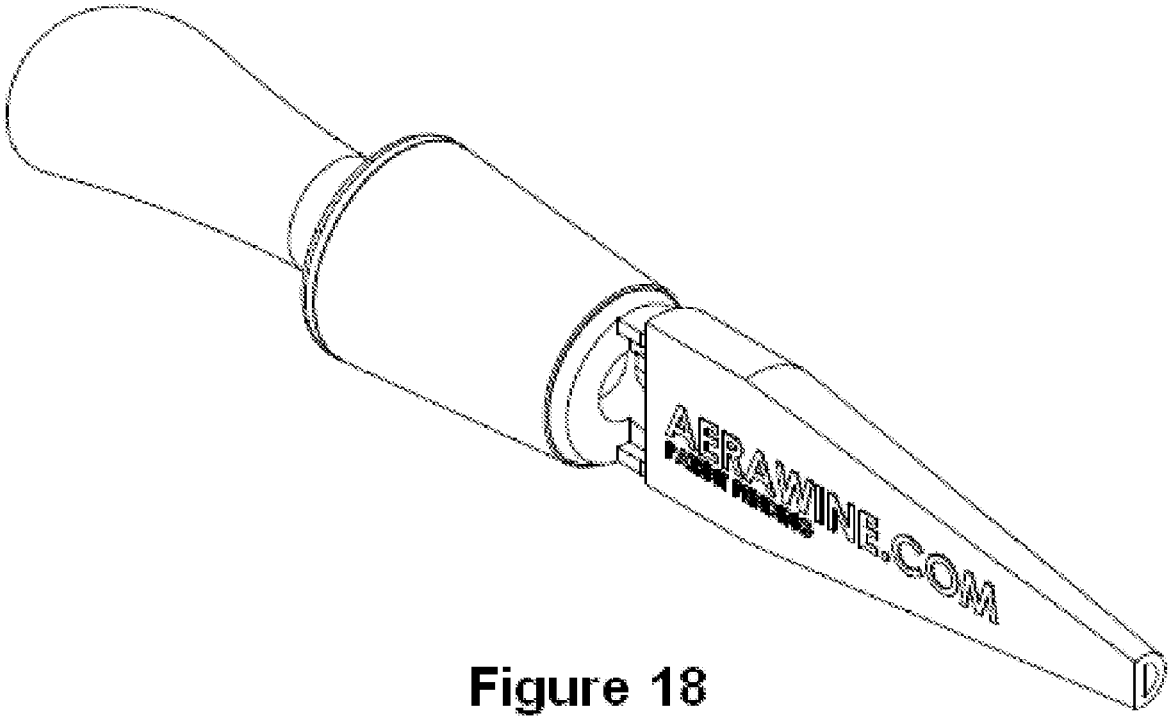
FIG. 18 is a perspective view of an embodiment which eliminates air outlet(s) 26, and allows the air to enter through fluid inlet 38.
Figure 19:
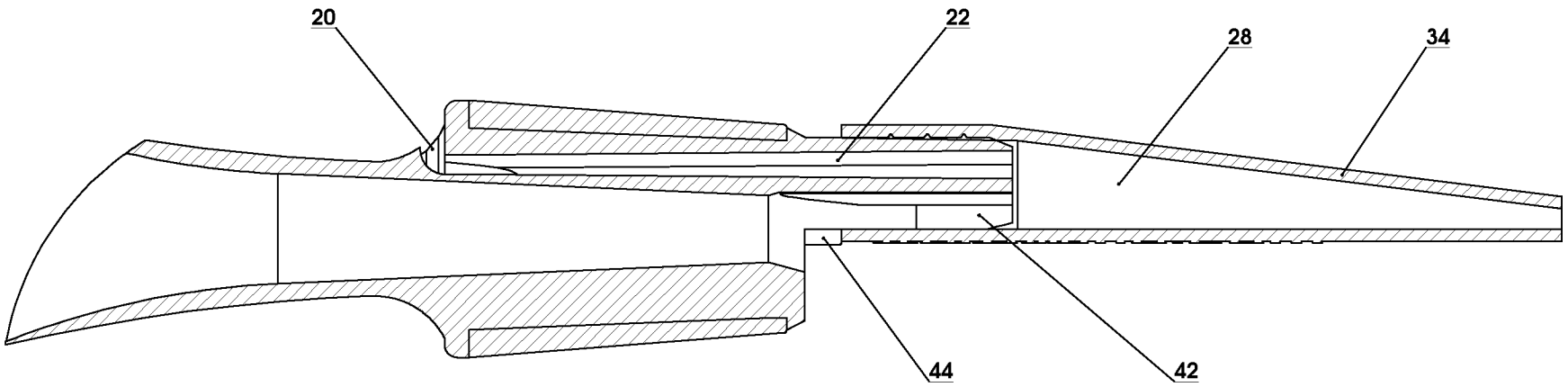
Figure 20:
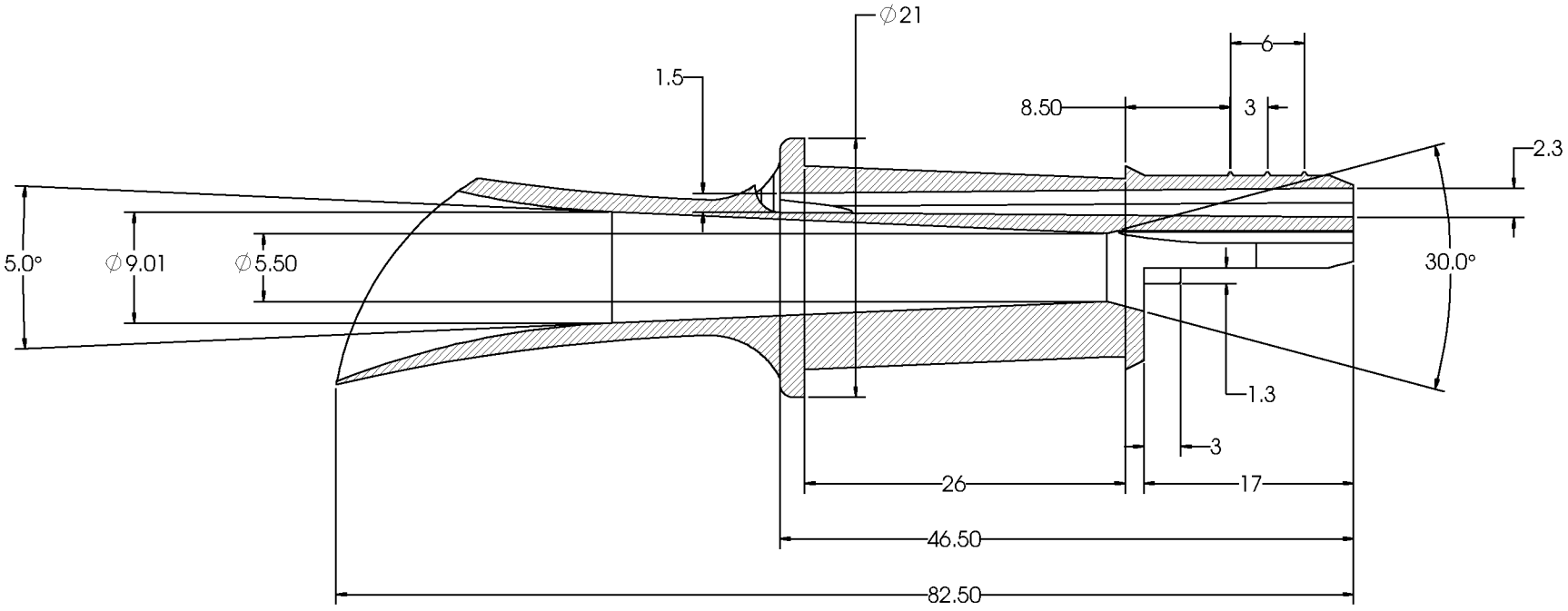
FIG. 20 is a cross-section view of the embodiment of FIG. 18 (without extension 34), showing dimensions.

Referring now to FIGS. 18-20, an embodiment of the invention is shown which eliminates air outlet 26. In this embodiment, the air channel 22 allows the air to flow into air tube extension 28 (defined by extension 34). The air splits and part exits 28 at 30, while part of the air flows up channel 42 and into fluid inlet 38. Extension 34 is not slid fully onto tab 40, but allows an approximately 2 mm gap to exist at 44, which creates a restriction to flow so the fluid is passing from a larger cross-section area to a narrower cross-section area defined by the restriction, and then to a larger cross-section area defined by bottom partition 14, before the constricted section 12. It has been found that varying the size of air inlet 22, fluid inlet 38 and gap 44 (in this embodiment or the amount of restriction in the other embodiments), will change the aeration behavior. The dimensions shown in the various embodiments provide a good balance of aeration and fluid flow rate out of the bottle.

Figure 21:
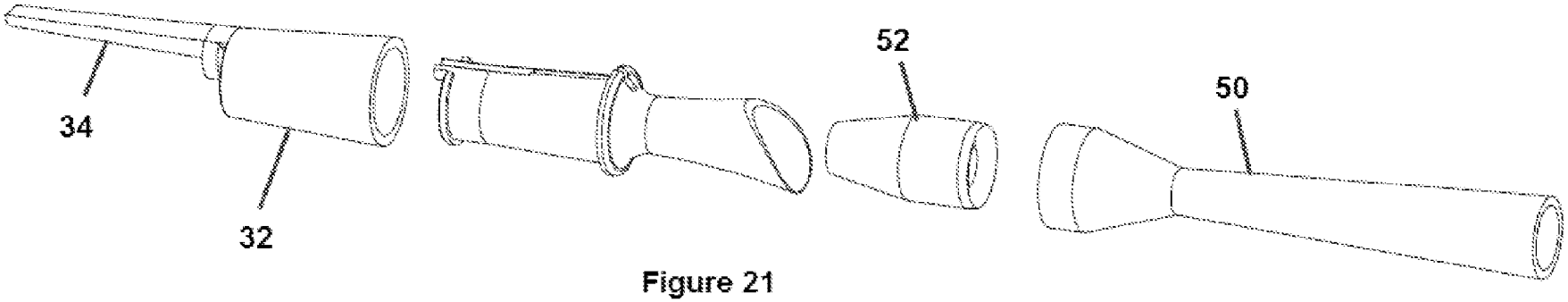
FIG. 21 is an exploded perspective view of a bottle aerator attachment, which further aerates the fluid by pouring it through an additional venturi tube, which re-aerates the fluid with the air already entrained in the fluid.
Figure 22:
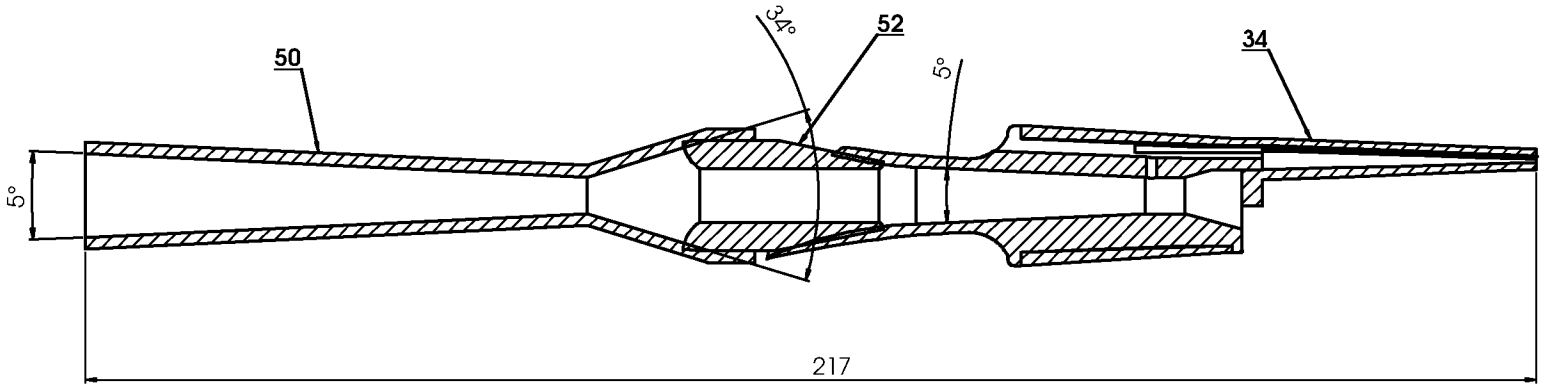
FIG. 22 is a cross-section view of the inventive attachment.

Referring now to FIGS. 21-22, a bottle aerator attachment 50 is shown. Attachment 50 is a secondary venturi tube which is designed to attach to any commercially available aerator, such as bottle aerator 10, or a handheld aerator, via elastic connector piece 52. Attachment 50 can either snap-fit or elastically attach to the pouring end of bottle aerator 10 (or the bottom end of handheld aerator) via connector 52. Attachment 50 is a venturi tube, which re-aerates the fluid pouring out of the pouring end of aerator 10, using the air already entrained in the fluid by the bottle aerator. If desired, multiple venturi tubes could be attached in series, to further aerate and re-mix the fluid with the entrained air. The aerator attachment can be used with a bottle aerator or a handheld aerator Applicant has also found experimentally that if the extension 34 is attached to the air tube end of a VinOAir wine aerator, extending furtherest into the wine bottle, that by restricting the size of the air outlet, the flow rate of the aerated wine pouring out of the bottle increases, with no loss of aeration.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims. Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below (e.g. claim 3 may be taken as alternatively dependent from claim 2; claim 4 may be taken as alternatively dependent on claim 2, or on claim 3; claim 6 may be taken as alternatively dependent from claim 5; etc.).

This completes the description of the preferred and alternate embodiments of the invention. Those skilled in the art may recognize other equivalents to the specific embodiment described herein which equivalents are intended to be encompassed by the claims attached hereto.

What is claimed is:

1. A bottle aerator having a venturi tube having a constricted section with a narrower cross-sectional section and a fluid inlet section having a wider cross-sectional section, and further including a liquid outlet section having a wider cross-section than the constricted section, such that the fluid pressure is lower in the constricted section compared to the pressure in the fluid inlet section, and the fluid speed is higher in the constricted section compared to the fluid speed in the fluid inlet section, the venturi tube constructed and arranged to be removably engaged to a bottle to form a liquid seal and for incorporating ambient air into a liquid stream as the liquid is poured from the bottle, the improvement comprising:

the constricted section being constructed and arranged so that when the bottle aerator is inserted into the bottle, the constricted section is positioned inside the bottle, further including at least one air tube extension located alongside the venturi tube, the at least one air tube extension is in fluid communication with air outside the bottle, the air tube extension having an air outlet opening into the interior of the bottle, the venturi tube further including at least one air outlet which is provided at or below the constricted section, the lower pressure in the constricted section creating a partial vacuum which pulls air from outside the bottle to mix with the fluid before it passes through the constricted section, so that the fluid is aerated while still inside the bottle.

2. A bottle aerator having a venturi tube having a constricted section with a narrower cross-sectional section and a fluid inlet section having a wider cross-sectional section, such that the fluid pressure is lower in the constricted section compared to the pressure in the fluid inlet section, and the fluid speed is higher in the constricted section compared to the fluid speed in the fluid inlet section, the improvement comprising:

providing at least one air outlet into the venturi tube, which is located inside the bottle, the lower pressure in the constricted section creating a partial vacuum which pulls air from outside the bottle to mix with the fluid as it passes through the constricted section, partially obstructing the air outlet opening to create a smaller air outlet opening, which speeds up the fluid pouring flow rate, wherein the partial obstruction is created by sliding an extension over the air outlet, to narrow the size of the air outlet, whereby the fluid pouring flow rate speeds up.

3. The bottle aerator of claim 2 wherein the constricted section is constructed and arranged so that when the bottle aerator is inserted into a bottle, the constricted section is positioned inside the bottle, so that the fluid is aerated while still inside the bottle.

4. A bottle aerator comprising:

a venturi tube having a constricted section, and top and bottom sections having a wider cross-section than the constricted section;

the venturi tube being removably engaged to a bottle, for pouring a fluid from the bottle;

the constricted section and bottom section of the venturi tube being positioned inside the bottle when the bottle aerator is removably engaged to a bottle;

the bottom section of the venturi tube having a fluid inlet to allow the fluid to enter the venturi tube as it is poured from a bottle, the fluid flowing faster as it passes through the constricted section;

the top section of the venturi tube forming a pouring spout;

the venturi tube having an air inlet channel which allows air to pass from outside the bottle and at least one air outlet which allows the air to enter the venturi tube either at the constricted section or below the constricted section, the venturi tube creating a partial vacuum which pulls air from outside the bottle into the venturi tube to aerate the fluid as it passes through the constricted section as it is being poured out of the bottle an elastic sleeve which fits around at least the part of the venturi tube contacting an opening in the bottle, to provide a seal when the bottle aerator is removably engaged to the bottle further including an air tube extension which is connected to air inlet channel at the bottom of the venturi tube and which is in fluid communication with the air inlet channel, which extends downwardly below the fluid inlet of the bottom section and which has a lower air outlet, and wherein the air tube extension is spaced an adjustable distance below the fluid inlet to the venturi tube, the adjustable distance changing the rate at which the fluid pours out of the bottle aerator.

5. The bottle aerator of claim 4 wherein the air tube extension is spaced a predetermined distance below the fluid inlet to the venturi tube.

6. The bottle aerator of claim 4 wherein the predetermined distance is approximately 2 mm from the fluid inlet.

7. The bottle aerator of claim 6 wherein the diameter of constricted section is approximately 5.5 mm.

8. The bottle aerator of claim 7 wherein the bottom section of the venturi tube tapers at a 30° angle from its wider cross-section to the constricted section.

9. The bottle aerator of claim 6 wherein the air tube extension is constructed and arranged to partially restrict the flow of fluid into the fluid inlet of the venturi tube.

10. The bottle aerator of claim 6 wherein the fluid inlet is partially obstructed, so that the cross-section of the flow path below the fluid inlet is wider than the cross-section of the flow path at the partial obstruction, and the cross-section of the flow path above the fluid inlet is wider than the cross-section of the flow path at the partial obstruction and also wider than the cross-section at the constricted section.

11. The bottle aerator of claim 4 wherein the fluid inlet is partially obstructed, so that the cross-section of the flow path below the fluid inlet is wider than the cross-section of the flow path at the partial obstruction, and the cross-section of the flow path above the fluid inlet is wider than the cross-section of the flow path at the partial obstruction and also wider than the cross-section at the constricted section.

12. The bottle aerator of claim 4 wherein the at least one air outlet is positioned to a side of the air channel, and at least one side channel allows air to flow from the air channel to the at least one air outlet.

13. The bottle aerator of claim 4 wherein the at least one air outlet is connected to the constriction section.

14. The bottle aerator of claim 4 wherein the at least one air outlet is connected to the bottom section.

15. The bottle aerator of claim 4 wherein the at least one air outlet is below the bottom section, and air is allowed to pass into the fluid inlet, along with fluid.

16. The bottle aerator of claim 4 further including an additional venturi tube attached to the pouring end of the bottle aerator, to further mix and re-aerate the fluid with the air already entrained in the fluid.

17. The bottle aerator of claim 4 further including a flow restrictor which limits the flow of fluid into the fluid inlet.

18. An improved bottle aerator having a venturi tube with its constriction section positioned outside the bottle, and with an air extension tube with an air outlet extending into the bottle, the improvement comprising:

partially obstructing the air outlet opening to create a smaller air outlet opening, which speeds up the fluid pouring flow rate, wherein the partial obstruction is created by sliding an extension over the air outlet, to narrow the size of the air outlet, whereby the fluid pouring flow rate speeds up.

19. A bottle aerator having a venturi tube having a constricted section with a narrower cross-sectional section and a fluid inlet section having a wider cross-sectional section, and further including a liquid outlet section having a wider cross-section than the constricted section, such that the fluid pressure is lower in the constricted section compared to the pressure in the fluid inlet section, and the fluid speed is higher in the constricted section compared to the fluid speed in the fluid inlet section, the venturi tube constructed and arranged to be removably engaged to a bottle to form a liquid seal and for incorporating ambient air into a liquid stream as the liquid is poured from the bottle, the improvement comprising:

the constricted section being constructed and arranged so that when the bottle aerator is inserted into the bottle, the constricted section is positioned inside the bottle, further including at least one air tube extension located alongside the venturi tube, the at least one air tube extension is in fluid communication with air outside the bottle, the air tube extension having an air outlet opening into the interior of the bottle, further including at least one air outlet opening, located below and upstream from the fluid inlet of the venturi tube, near but not emanating from the venturi tube, and the at least one air outlet opening is in fluid communication with air outside the bottle the lower pressure in the constricted section creating a partial vacuum which pulls air from outside the bottle to mix with the fluid before it passes through the fluid inlet and constricted sections for further mixing.

20. The bottle aerator of claim 19 wherein the at least one air outlet opening is movable.

21. A bottle-top aerator having a channel through which fluid is poured from a bottle, the channel comprised of a fluid inlet section, a constricted section, and a fluid outlet section, the fluid inlet section and the fluid outlet section having a greater cross-sectional area than the cross-sectional area of the constricted section such that when fluid passes through the channel the fluid pressure is lower in the constricted area compared to the pressure in the fluid inlet section, and the fluid speed is higher in the constricted section compared to the fluid speed in the fluid inlet section, the channel constructed and arranged to be removably engaged to a bottle to form a liquid seal and for incorporating ambient air into a fluid stream as fluid is poured from the bottle, the improvement comprising:

the constricted section being constructed and arranged so that when the bottle aerator is inserted into the bottle, the constricted section is positioned inside the bottle, further including at least one air tube extension located alongside the channel, the at least one air tube extension being in fluid communication with air outside the bottle, the air tube extension having an air outlet opening into the interior of the bottle, further including at least one air outlet which is in fluid communication with air outside the bottle, the at least one air outlet provided below or upstream from the constricted section, the lower pressure in the constricted section creating a partial vacuum which pulls air from outside the bottle through the at least one air outlet to mix with the fluid before and as it passes through the constricted section and the fluid outlet section.

22. The bottle aerator of claim 21 wherein the at least one air outlet opening is movable.

* * * * *